US007600887B2

(12) United States Patent
Sherman

(10) Patent No.: US 7,600,887 B2
(45) Date of Patent: Oct. 13, 2009

(54) EDGE MOUNT SHELF LIGHT ASSEMBLY

(75) Inventor: Ryan Todd Sherman, Seattle, WA (US)

(73) Assignee: LucaLight, LLC, Seattle, WA (US)

( * ) Notice: Subject to any disclaimer, the term of this patent is extended or adjusted under 35 U.S.C. 154(b) by 48 days.

(21) Appl. No.: 11/453,363

(22) Filed: Jun. 14, 2006

(65) Prior Publication Data

US 2007/0291480 A1 Dec. 20, 2007

(51) Int. Cl.
*F21V 21/00* (2006.01)

(52) U.S. Cl. ..... 362/217.1; 362/125; 362/133; 362/219; 362/217.12; 362/217.13; 362/217.14; 362/217.15; 362/217.16

(58) Field of Classification Search ..... None
See application file for complete search history.

(56) References Cited

U.S. PATENT DOCUMENTS 2,038,035 A * 4/1936 Friedrich ..... 49/210
2,106,839 A 2/1938 Gilbert
D146,982 S 6/1947 Phillips
2,710,336 A * 6/1955 Jorn ..... 362/368
3,435,204 A * 3/1969 Lepak ..... 362/223
4,164,009 A * 8/1979 Maguire et al. ..... 362/127
4,195,890 A * 4/1980 Kellogg ..... 312/265.2
4,365,590 A * 12/1982 Ruggieri et al. ..... 119/418
4,434,453 A * 2/1984 Campbell ..... 362/33
4,489,995 A 12/1984 Barr
4,622,624 A 11/1986 McCarthy et al.
4,689,726 A * 8/1987 Kretzschmar ..... 362/127
4,739,454 A * 4/1988 Federgreen ..... 362/133
5,034,861 A 7/1991 Sklenak et al.
5,040,101 A 8/1991 Aspenwall
5,072,343 A * 12/1991 Buers ..... 362/125
D330,090 S 10/1992 Walter et al.
5,508,898 A * 4/1996 McGovern ..... 362/92
5,626,084 A 5/1997 Kelly et al.
5,690,415 A 11/1997 Krehl (Continued)

FOREIGN PATENT DOCUMENTS

DE 29514745 U1 11/1995

(Continued)

OTHER PUBLICATIONS

Communication Relating to the Results of the Partial International Search Report by the European Patent Office dated Oct. 16, 2007, issued in corresponding Int'l Application No. PCT/US07/70606, filed Jun. 7, 2007.

*Primary Examiner*—Sandra L O'Shea
*Assistant Examiner*—Danielle Allen
(74) *Attorney, Agent, or Firm*—Christensen O'Connor Johnson Kindness PLLC

(57) ABSTRACT

The present disclosure provides a light assembly (6) for connection to a shelving unit having an elongated housing (10). The elongated housing (10) includes a mounting face (12), an outer face (16) formed opposite the mounting face (12), and an upper face (14) extending between the mounting face (12) and the outer face (16). At least one lamp fastening member (24) is formed within the housing (10), and an attachment channel (20) is formed within the mounting face (12) of the housing (10) and opens to the outer side of the mounting face (12). The attachment channel (20) is adapted to receive at least one fastener.

14 Claims, 5 Drawing Sheets

U.S. PATENT DOCUMENTS

| | | | | |
|---|---|---|---|---|
| 5,758,585 | A | 6/1998 | Latchinian | |
| 5,984,486 | A | 11/1999 | Munz et al. | |
| 6,179,434 | B1 * | 1/2001 | Saraiji | 362/125 |
| 6,231,205 | B1 | 5/2001 | Slesinger et al. | |
| 6,270,232 | B1 | 8/2001 | Shemitz et al. | |
| 6,276,810 | B1 | 8/2001 | Vosshenrich | |
| 6,431,721 | B2 | 8/2002 | Shemitz et al. | |
| 6,558,017 | B1 | 5/2003 | Saraiji et al. | |
| 6,565,234 | B1 | 5/2003 | Skegin et al. | |
| 6,808,285 | B2 * | 10/2004 | Shemitz et al. | 362/125 |
| 6,827,463 | B2 | 12/2004 | Chuang et al. | |
| 6,827,465 | B2 | 12/2004 | Shemitz et al. | |
| 6,974,375 | B1 | 12/2005 | Stevenson | |
| 2005/0082450 | A1 | 4/2005 | Barrett et al. | |

FOREIGN PATENT DOCUMENTS

| | | | |
|---|---|---|---|
| DE | 10311876 | A1 | 11/2004 |
| WO | 98/49490 | A1 | 11/1998 |

* cited by examiner

EDGE MOUNT SHELF LIGHT ASSEMBLY

BACKGROUND

Lighting assemblies for shelves are used to illuminate the contents on a shelf. These assemblies are designed to eliminate the need for overhead lighting or higher levels of ambient light. Lighting assemblies may be used for various types of shelving units, such as library shelves, magazine stands, retail shelves, grocery shelves, etc.

SUMMARY

The present disclosure provides a light assembly for connection to a shelving unit having an elongated housing. The elongated housing includes a mounting face, an outer face formed opposite the mounting face, and an upper face extending between the mounting face and the outer face. At least one lamp fastening member is formed within the housing, and an attachment channel is formed within the mounting face of the housing and opens to the outer side of the mounting face. The attachment channel is adapted to receive at least one fastener.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figures 1A, 1B, 1C, 1D:
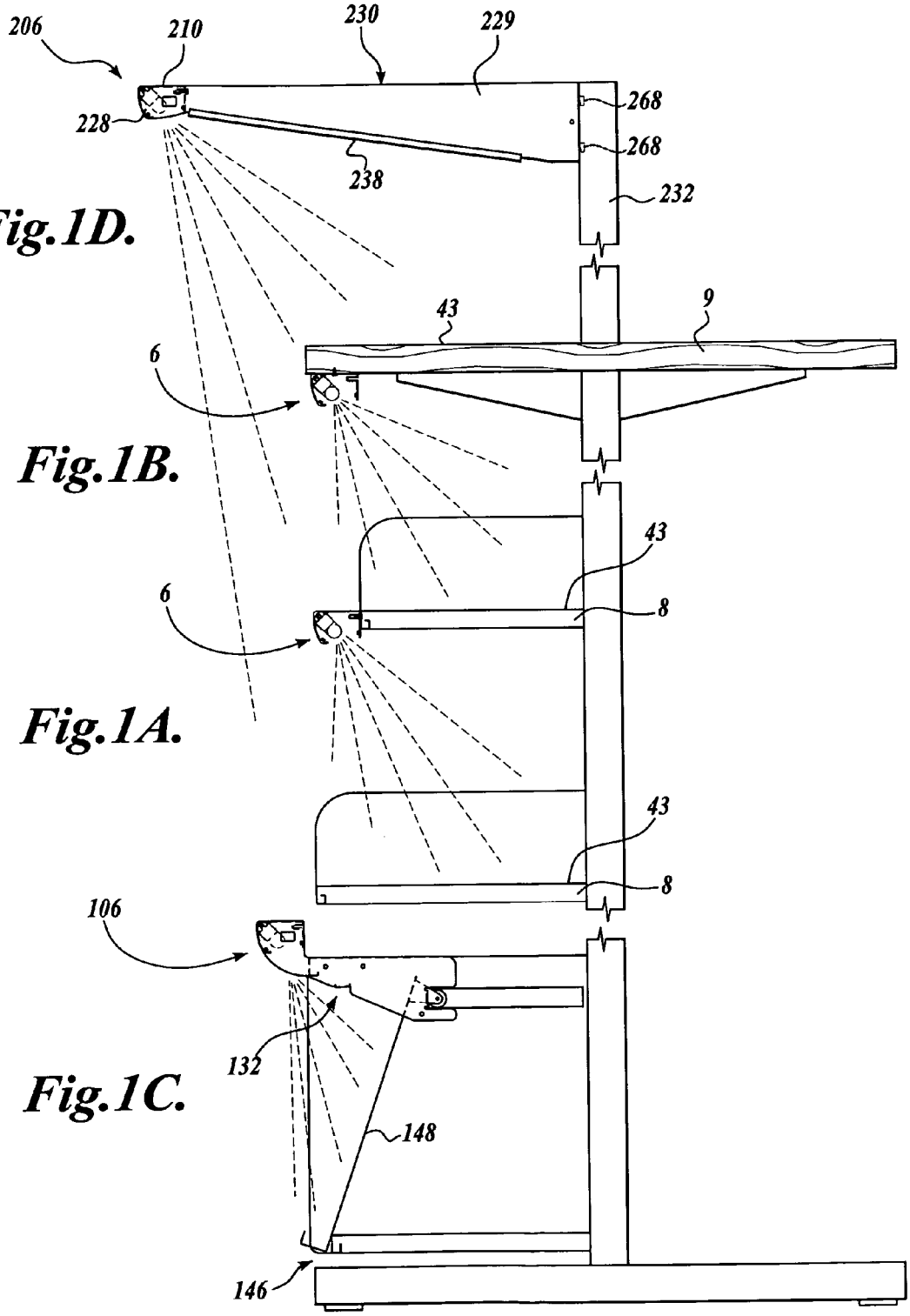
FIG. 1A is a side view of a shelf light assembly mounted to the edge of a shelf.
FIG. 1B is a side view of the shelf light assembly of FIG. 1A mounted to the underside of a shelf.
FIG. 1C is a side view of a first alternate embodiment of the shelf light assembly of FIG. 1A mounted to a shelving unit.
FIG. 1D is a side view of a second alternate embodiment of the shelf light assembly of FIG. 1A mounted to a shelving unit.

Referring to FIG. 1A, a shelf light assembly 6 formed in accordance with one embodiment of the present disclosure is depicted. Generally described, the shelf light assembly 6 includes an extruded housing 10 that houses a lamp 18. The extruded housing 10 is mounted to the edge of a shelf 8 to direct the lighting towards the shelf contents below. Moreover, the extruded housing 10 is mounted to the edge of the shelf 8 so that the housing 10 essentially creates an extension of the shelf 8. It should be appreciated that the shelf light assembly 6 may be used with any suitable shelving system. For instance, the assembly may be used with library shelves, magazine stands, retail shelves, grocery shelves, etc.

Figure 2A:
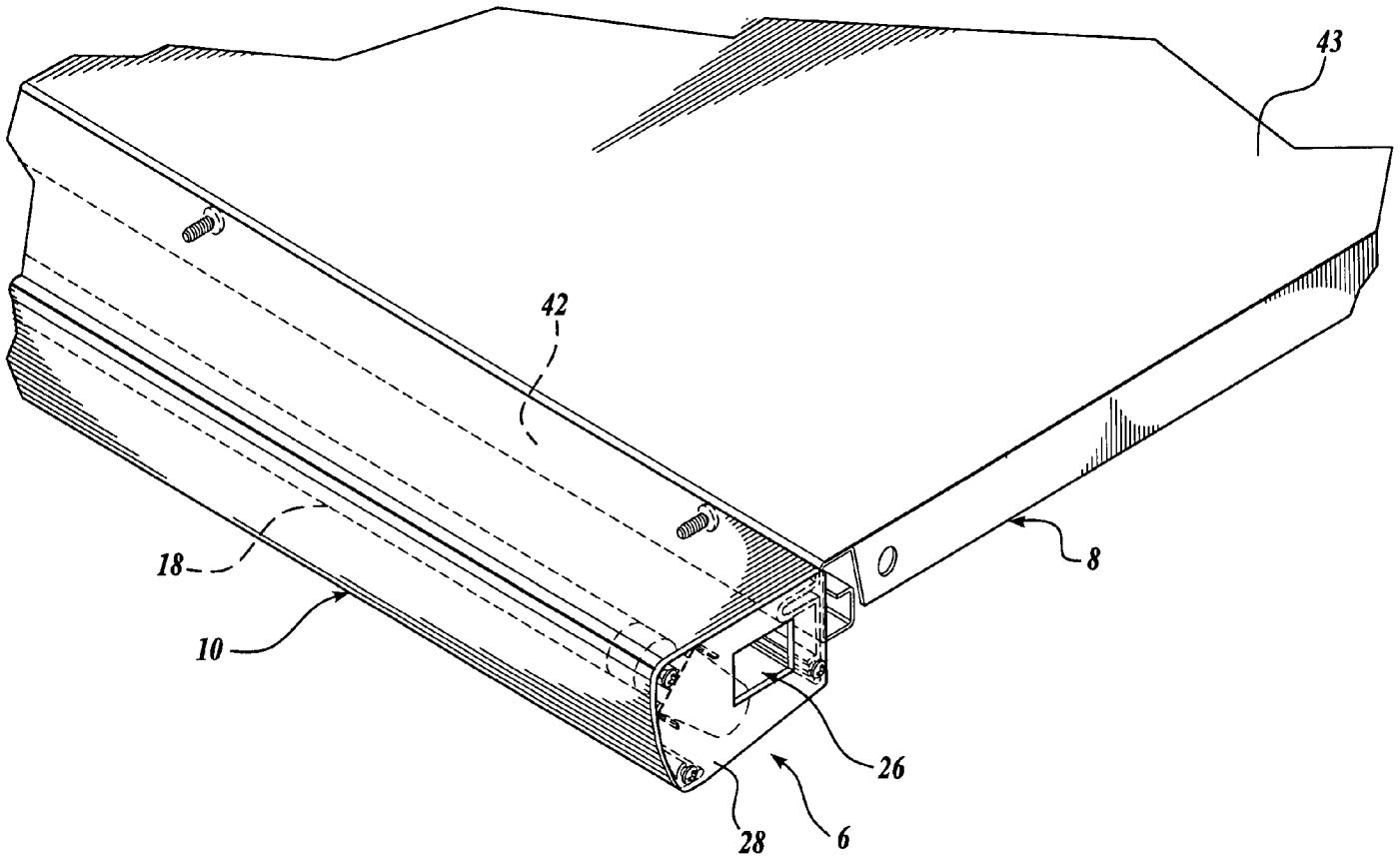
FIG. 2A is a partial isometric view of the shelf light assembly of FIG. 1.

Referring to FIG. 2A, the shelf light assembly 6 includes an aluminum extruded housing 10 that is generally C-shaped in cross section, although other similar shapes may also be used. As can best be seen by referring to FIG. 2B, the housing 10 includes a substantially flat, rear mounting face 12, a substantially flat, upper face 14, and a curved outer face 16. The mounting face 12 and the upper face 14 are substantially perpendicular to one another and the curved outer face 16 extends downwardly and rearwardly from the upper face 14. The bottom of the curved outer face 16 includes a lip 29 that extends inwardly from the bottom of the curved outer face 16 towards the rear mounting face 12. The bottoms of the mounting face 12 and the outer face 16 are spaced from each other, leaving a bottom opening. The housing 10 is extruded in a manner well known in the art and it is cut to a preferred length to fit the target shelf. The extruded housing 10 can also be cut to fit the length of multiple shelves positioned adjacent one another in a shelving system.

The rear face 12 of the housing 10 includes at least one perpendicular attachment channel or first perpendicular screw boss 20 that is extruded lengthwise along the housing 10 and opens to the exterior of the mounting face 12. A second perpendicular attachment channel or second perpendicular screw boss 24 is extruded along the interior of the housing 10 at the corner defined by the intersection of the upper face 14 and the curved outer face 16, and it opens to the interior of the housing 10 at an approximately forty-five degree angle to the upper face 14. The housing 10 also includes a plurality of longitudinal attachment channels, or longitudinal screw bosses 22. Preferably, the housing 10 includes three longitudinal screw bosses 22*a*, 22*b*, and 22*c*. Longitudinal screw boss 22*a* is extruded along the interior of housing 10 near the bottom of the mounting face 12. Longitudinal screw boss 22*b* is extruded along the interior of the housing 10 at the corner defined by the intersection of the curved outer face 16 and the lip 29. Longitudinal screw boss 22*c* is extruded along the interior of the housing 10 at the corner defined by the intersection of the upper face 14 and the curved outer face 16. In other words, longitudinal screw boss 22*c* is formed within the bottom of second perpendicular screw boss 24.

Figure 2B:
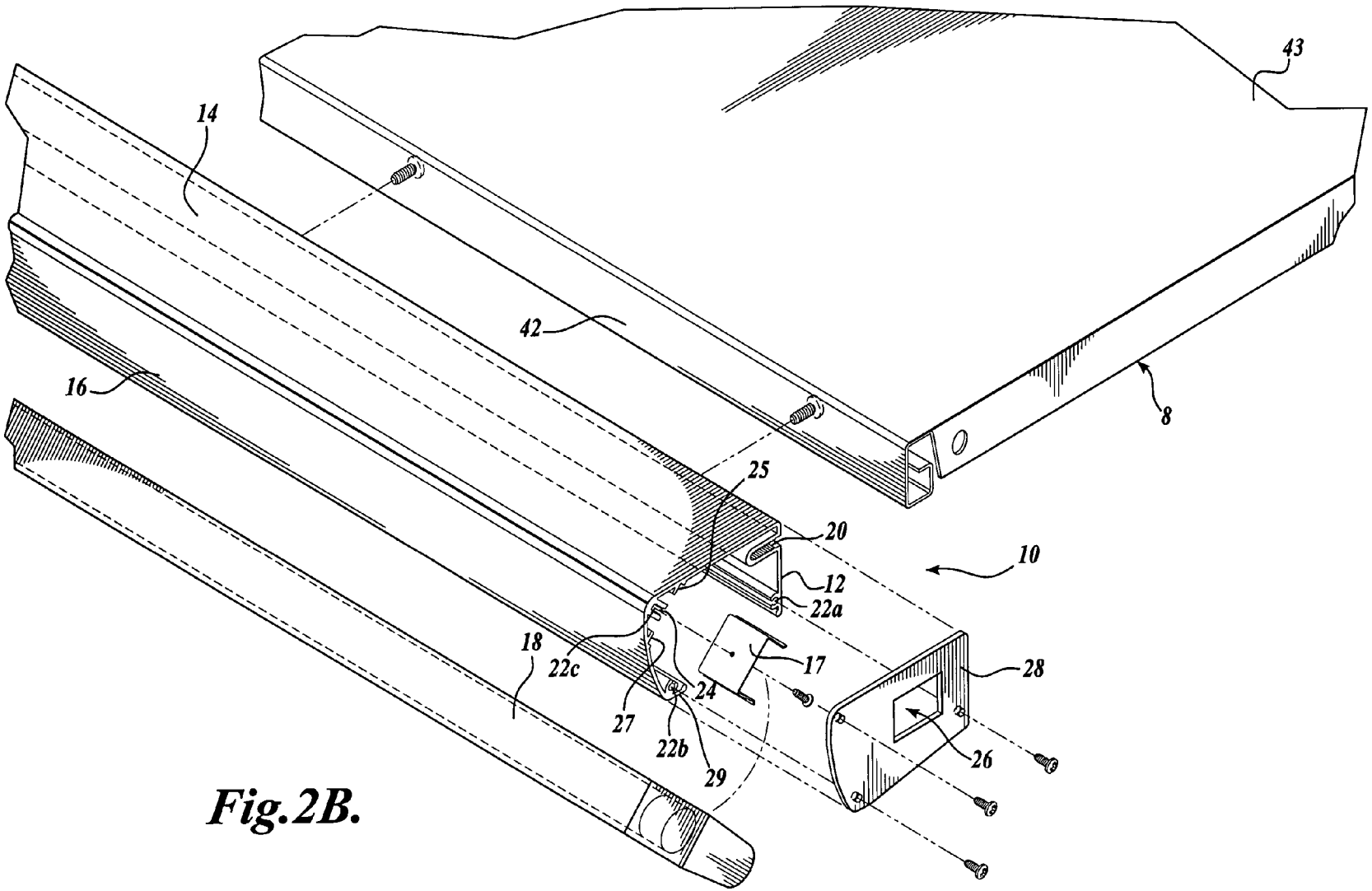
FIG. 2B is a partial exploded view of the shelf light assembly of FIG. 2A.

Still referring to FIG. 2B, first and second shoulders 25 and 27 are extruded along the interior of the housing 10 on opposite sides of the corner defined by the intersection of the upper face 14 and the curved outer face 16. The shoulders 25 and 27 extend into the interior of the housing 10 toward the second perpendicular screw boss 24. A lamp clip 17 that is substantially U-shaped in cross section is mounted in the interior of the housing 10 such that it spans the corner defined by the intersection of the upper face 14 and the curved outer face 16. The bottom of the lamp clip 17 is mounted against shoulders 25 and 27 and second perpendicular screw boss 24 so that the clip 17 opens to the interior of the housing 10 at an approximately forty-five degree angle to the upper face 14. At least one screw or other threaded fastener is passed through the bottom of the lamp clip 17 and is received into the second perpendicular screw boss 24 to fasten the clip 17 within the housing 10. A lamp 18 is received within the lamp clip 17. The cross-section of the lamp clip 17 generally conforms in shape and size to the cross-sectional shape of the lamp 18 in order to tightly receive the lamp 18. The lamp clip 17 is formed from sheet metal or another suitable material, such as plastic, such that the sides of the clip 17 may bend out slightly when receiving the lamp 18 so that the lamp 18 may be snapped therewithin. The lamp 18 is preferably a fluorescent lamp that receives power from a power cord; however, jumpers may be used to connect lamps 18 between adjacent shelves in a shelving system. Preferably, a T4 (0.5" diameter bulb) or T5 (⅝" diameter bulb) fluorescent lamp fixture is used; however, other lamps may also be used without departing from the spirit and scope of the present disclosure.

End plates 28 formed from sheet metal, plastic, or another suitable material, are secured to the open ends of the housing 10 by passing a screw or other threaded fastener through the end plate 28 and into each screw boss 22*a*, 22*b*, and 22*c*. The end plate 28 is preferably the same shape and size as the cross section of the housing 10. It should be understood that the end plates 28 may be secured to the end of the housing 10 in any other well-known manner, such as welding, glue, etc. Moreover, fewer or more than three screw bosses 22 may be used to secure the end plate 28 to the housing 10, and the screw bosses 22 may instead be formed in other locations within the interior of the housing 10. The end plates 28 include a cord opening 26 through which the lamp power cord or jumper may pass.

Referring to FIGS. 2A and 2B, the housing 10 is mounted to the edge 42 of a shelf 8. The shelf 8, which is formed from any suitable material, such as sheet metal, includes an upper surface 43 and an overhanging edge 42. The shelf light assembly 6 is mounted to the edge 42 of the shelf 8 by passing at least one threaded fastener such as a screw through the backside of the edge 42 and into the first perpendicular screw boss 20. The shelf light assembly 6 is mounted to the shelf 8 such that the upper face 14 of the housing 10 is flush with the upper surface 43 of the shelf 8. Moreover, the rear mounting face 12 of the housing 10 abuts the edge 42 of the shelf 8 such that little or no gap is defined therebetween. In this manner, the shelf light assembly 6 essentially acts as an extension of the shelf 8.

The lamp 18, which is received within the lamp clip 17 at an approximately forty-five degree angle to the upper face 14, projects light downwardly and inwardly through the bottom opening defined by the ends of the mounting face 12 and the outer face 16 toward the shelf contents below, as shown in FIG. 1A. A shelf light assembly 6 may be mounted to the edge 42 of each shelf 8 within a plurality of stacked shelves such that the contents of each shelf are illuminated.

Referring to FIG. 1B, the shelf light assembly 6 may instead be mounted to the underside of a solid shelf 9, such as a wooden shelf, by passing a screw or other threaded fastener through the interior surface of the upper face 14 of the housing 10 and into the bottom of the shelf. In this manner, the shelf light assembly 6 can be used to illuminate the shelf contents below even when there is no shelf edge for mounting the assembly 6 thereto.

Now referring to FIG. 1C, a first alternate embodiment of the shelf light assembly 106 is depicted, wherein like numerals represent like parts. The shelf light assembly 106 is mounted to a shelving unit 146 having a retractable shelf/door 148. As can best be seen by referring to FIG. 4, one embodiment of a shelving unit 146 having a retractable shelf/door 148 is depicted, although it should be appreciated that any similar shelving unit may be used. The shelving unit 146 includes a polygonal-shaped shelf housing 152 having an upper surface 160, two side walls (not shown), an interior bottom shelf 162, a rear surface 168 and a hollow interior 150. The retractable shelf/door 148 spans between the two side walls to enclose the hollow interior 50. A lip for holding and displaying items, such as magazines, books, etc., is formed along the bottom of the retractable shelf/door 148. The bottom portion of the shelf/door 148 abuts the edge of the interior bottom shelf 162, and the upper end of the retractable shelf/door 148 is pivotally coupled to a roller bearing assembly 154 disposed within a horizontal channel 156 is formed near the upper surface 160 of the shelving unit 146. The channel 156 defines upper and lower bearing surfaces 157 so that the bearing assembly 154 may be horizontally translated therewithin.

The retractable shelf/door 148 is pivotably mounted to the bearing assembly 154 such that the shelf/door 148 may be lifted at its bottom edge and translated about the bearing assembly center axis to expose the hollow interior 150 of the shelving unit 146. Once lifted, the retractable shelf/door 148 can be retracted within the shelving unit 146 through the horizontal translation of the bearing assembly 154 within channel 156.

Figure 3:
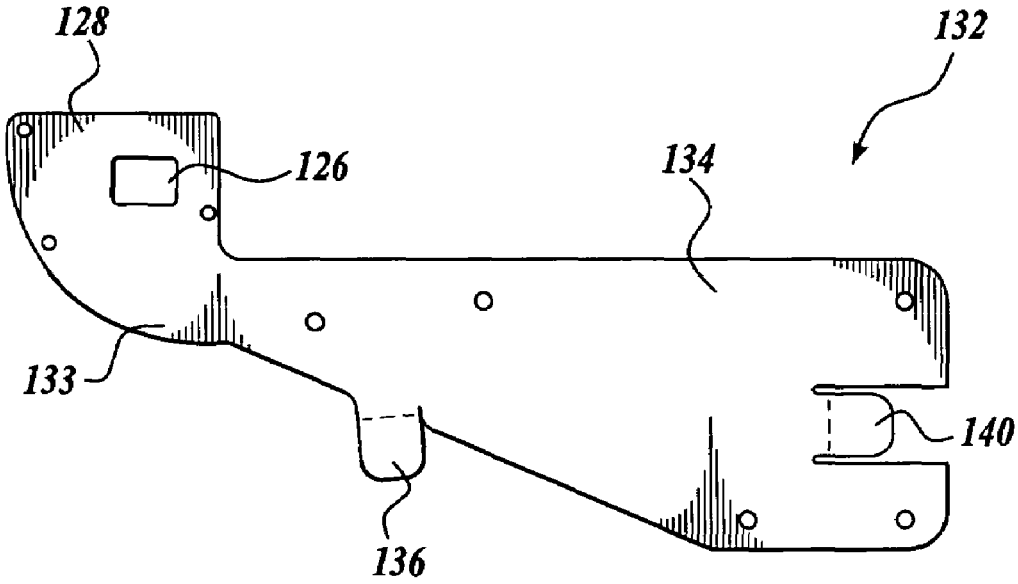
FIG. 3 is a top view of a mounting bracket for use with the first alternate embodiment of the shelf light assembly of FIG. 1C.
Figure 4:
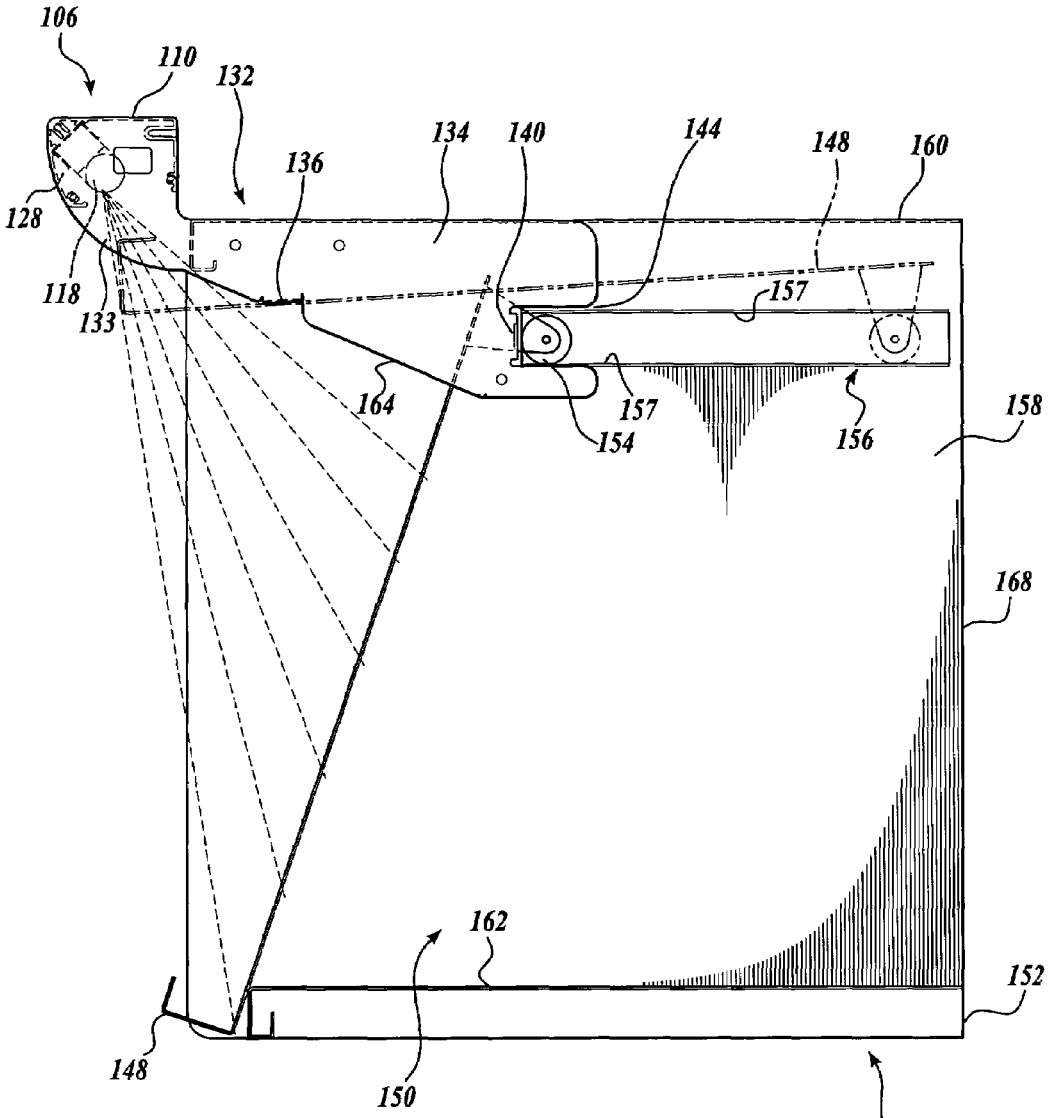
FIG. 4 is a partial side view of the first alternate embodiment of the shelf light assembly of FIG. 1C mounted to a shelving unit.

Referring to FIGS. 3 and 4, mounting brackets 132 are used to secure the shelf light assembly 106 to the shelving unit 146 in a manner such that the retractable shelf/door 148 does not interfere with or hit the housing 110 when the retractable shelf/door 148 is raised and retracted. The mounting bracket 132 includes an end plate portion 128, a polygonal mounting portion 134, and an intermediate portion 133 interconnecting the end plate portion 128 and the polygonal mounting portion 134. The end plate portion 128 is substantially the same shape and size as the open ends of the housing 106. The intermediate portion 133 of the mounting plate 132 connects the end plate portion 128 and the polygonal mounting portion 134, and it projects the end plate portion 128 outwardly from and above the polygonal mounting portion 134.

The polygonal mounting portion 134 is substantially rectangular in shape and has a bottom diagonal edge 164 and a side edge 166, although other shapes may also be used. A first tab 136 is formed along the bottom diagonal edge 164 of the polygonal mounting portion 134 and extends outwardly therefrom. The first tab 136 is bent upwardly until it is substantially perpendicular to the polygonal mounting portion 134. The first tab 136 is formed along the bottom diagonal edge 164 at an angle such that when it is bent upwardly, first tab 136 is tilted in a slight downward direction away from the end plate portion 128. A slot 144 is formed inwardly of the side edge 166 of the polygonal mounting portion 134. The slot 144 is sized to receive at least a portion of the channel 156 formed within the interior of the shelving unit 146. A second tab 140 is formed along the bottom of the slot 144. The second tab 140 is bent in a substantially perpendicular position to the polygonal mounting portion 134 so that the second tab 140 abuts the channel 156 when received within slot 144. Referring back to FIG. 4, the mounting bracket 132 is used to secure the housing 110 to the shelving unit 146. The end plate portion 128 is secured to the open end of the housing 110, as described above. The polygonal mounting portion 134 is secured to an interior surface of a side wall (not shown) of the shelf housing 152 such that tabs 136 and 140 extend inwardly toward the hollow interior 150 of the shelving unit 146. The polygonal mounting portion 134 is secured within the shelf housing 152 such that slot 144 partially receives channel 156 and second tab 140 abuts the end of channel 156. The polygonal mounting portion 134 is also positioned on the interior surface of the shelf housing 152 such that the upper surface of the polygonal mounting portion 134 abuts the upper surface 160 of shelf housing 152. In this manner, the end plate portion 128 and housing 110 are projected above the shelving unit 146 such that light from the lamp 118 is projected downwardly and inwardly toward contents on the retractable shelf/door 148. When the retractable shelf/door 148 is raised and retracted within the shelving unit 146, tab 136 prevents the retractable shelf/door 148 from hitting or interfering with housing 110.

Now referring to FIG. 1D, a second alternate embodiment of a shelf light assembly 206 is depicted, wherein like numerals refer to like parts. In this embodiment, an extension bracket 230 is used to mount the housing 210 to the top of a shelf column 232 of a shelving assembly to create lighting for an entire shelving unit. The extension bracket 230 includes an elongated polygonal mounting portion 229 and an end plate portion 228. Although the elongated polygonal mounting portion 229 may be any suitable shape, it is preferably rectangular-shaped and has a bottom diagonal edge that extends upwardly toward the end plate portion 228.

A plurality of hooks 246 extend outwardly from the end of the polygonal mounting portion 229 opposite the end plate portion 228. The hooks 268 are received into apertures in the shelf column 232 (not shown) to mount the extension bracket 230 thereto.

A curved lip 238 is formed along the bottom diagonal edge of the polygonal mounting portion 229 of the extension bracket 230. The power cord from the lamp 218 passes through the cord opening 226 and is received within the curved lip 238. In this manner, excess cord needed to plug in the lamp 218 is secured next to the extension bracket 230. As an alternative, a plastic wire track, cable channel, cable clip, etc. commonly available and known in the art may be used instead of, or in combination with the curved lip 238. A plurality of tracks, channels, or clips may be secured to the extension bracket 230 (normally with an adhesive), and the cord may thereafter be passed therethrough to secure the cord next to the extension bracket 230.

While illustrative embodiments have been illustrated and described, it will be appreciated that various changes can be made therein without departing from the spirit and scope of the invention.

The embodiments of the invention in which an exclusive property or privilege is claimed are defined as follows:

1. A light assembly for connection to a shelving unit, the assembly comprising:

(a) an elongated housing having a mounting face, an outer face formed opposite the mounting face, and an upper face extending between the mounting face and the outer face, the elongated housing having an interior and an exterior;

(b) at least one lamp fastening member formed within the interior of the elongated housing;

(c) an attachment channel formed within the mounting face of the elongated housing and opening to the exterior of the elongated housing, the attachment channel defined by a perpendicular screw boss that is sized and configured to receive at least one fastener; and (d) wherein the shelving unit further comprises at least one shelf having an edge and a top surface, wherein the elongated housing is sized and configured such that when it is positioned against the edge of the shelf and a fastener is passed through the edge of the shelf the fastener is received into the attachment channel in the mounting face to secure the elongated housing to the shelf and form a continuous extension of the shelf.

2. The assembly of claim 1, wherein the lamp fastening member is disposed within an interior corner of the elongated housing defined by the upper face and the outer face, such that when the lamp fastening member receives a lamp, the lamp directs light towards the contents on a shelf below.

3. The assembly of claim 1, wherein the edges of the mounting face, outer face, and upper face define first and second open ends of the elongated housing.

4. The assembly of claim 3, further comprising first and second end plates coupled to the first and second open ends of the elongated housing.

5. The assembly of claim 3, wherein the shelving unit includes a shelf door that can be raised and retracted within the shelving unit.

6. The assembly of claim 5, further comprising first and second end brackets coupled at least in part to the first and second open ends of the elongated housing and at least in part to the shelving unit, wherein at least one of the first and second end brackets includes a tab extending substantially perpendicular to the bracket to restrict the movement of the shelf door when it is raised and retracted within the shelving unit.

7. The assembly of claim 3, further comprising an extension bracket coupled in part to the open ends of the elongated housing and coupled in part to the shelving unit such that the elongated housing is positioned above and outwardly from the shelving unit so that it may project light on the shelving unit below.

8. A light assembly for connection to a shelving unit, the assembly comprising:

(a) an elongated housing having a mounting face, an outer face formed opposite the mounting face, and an upper face extending between the mounting face and the outer face, the elongated housing having an interior and an exterior;

(b) at least one lamp fastening member formed within the interior of the elongated housing;

(c) an attachment channel formed within the mounting face of the elongated housing and opening to the exterior of the elongated housing, the attachment channel defined by a perpendicular screw boss that is sized and configured to receive at least one fastener; and (d) wherein the shelving unit further comprises at least one shelf having an edge and a top surface and the elongated housing is sized and configured such that when it is positioned against the edge of the shelf and a fastener is passed through the edge of the shelf, the fastener is received into the attachment channel in the mounting face to secure the elongated housing to the shelf and form a continuous extension of the shelf, and wherein the elongated housing is sized and configured such that the upper face of the elongated housing is flush with the shelf top surface when the elongated housing is secured to the edge of the shelf.

9. The assembly of claim 8, wherein the lamp fastening member is disposed within an interior corner of the elongated housing defined by the upper face and the outer face, such that when the lamp fastening member receives a lamp, the lamp directs light towards the contents on a shelf below.

10. The assembly of claim 8, wherein the edges of the mounting face, outer face, and upper face define first and second open ends of the elongated housing.

11. The assembly of claim 10, further comprising first and second end plates coupled to the first and second open ends of the elongated housing.

12. The assembly of claim 10, wherein the shelving unit includes a shelf door that can be raised and retracted within the shelving unit.

13. The assembly of claim 12, further comprising first and second end brackets coupled at least in part to the first and second open ends of the elongated housing and at least in part to the shelving unit, wherein at least one of the first and second end brackets includes a tab extending substantially perpendicular to the bracket to restrict the movement of the shelf door when it is raised and retracted within the shelving unit.

14. The assembly of claim 10, further comprising an extension bracket coupled in part to the open ends of the elongated housing and coupled in part to the shelving unit such that the elongated housing is positioned above and outwardly from the shelving unit so that it may project light on the shelving unit below.

* * * * *